United States Patent [19]

Saito

[11] 4,145,631

[45] Mar. 20, 1979

[54] INCANDESCENT LAMP

[75] Inventor: Sozo Saito, Tokyo, Japan

[73] Assignee: Kondo Sylvania Kabushiki Kaisha, Tokyo, Japan

[21] Appl. No.: 809,070

[22] Filed: Jun. 22, 1977

[30] Foreign Application Priority Data

Apr. 23, 1977 [JP] Japan ..... 52-47055

[51] Int. Cl.[2] ..... H01K 1/22; H01K 1/28; H01K 1/36

[52] U.S. Cl. ..... 313/315; 313/220; 313/222; 313/318

[58] Field of Search ..... 313/222, 220, 315, 318

[56] References Cited

U.S. PATENT DOCUMENTS 3,020,437 2/1962 Horan ..... 313/318

3,275,879 9/1966 Demarest et al. ..... 313/318 X 3,757,105 9/1973 McCarthy ..... 313/220 X

OTHER PUBLICATIONS

"Materials and Techniques for Electron Tubes," by W. H. Kohl, Chapter Entitled "Glass-to-Metal Sealing," 1966, p. 416 (Induction Seals), and pp. 443, 444 (Nickel-Chrome-Iron Alloy Seals).

*Primary Examiner*—Palmer C. Demeo

*Attorney, Agent, or Firm*—Wenderoth, Lind & Ponack

[57] ABSTRACT

An improved incandescent lamp includes a bulb, a stem, a metal ring body, a filament and lead wires penetrating the stem. The metal ring body is air-tightly welded to the stem and the bulb respectively with the use of oxidation layers on the inner and outer surface thereof to thereby provide hermetic seals therebetween.

2 Claims, 9 Drawing Figures

INCANDESCENT LAMP

BACKGROUND OF THE INVENTION

This invention relates to an incandescent lamp, and more particularly to an incandescent lamp which includes pins to be inserted into a socket and a method of manufacturing the same.

Although there are available many various kinds of constructions of such a lamp and also a variety of methods of manufacturing the same, the most generally used method is one wherein such a lamp is manufactured by the steps of welding a filament to lead wires or supports which penetrate a glass stem, hermetically sealing a bulb to the stem, exhausting air through an exhaust tube provided on the stem or bulb, and finally securing an appropriate base to the lead wires external to the stem. In general, there are provided bases in all kinds of lamps except for those used for special purposes. The provision of these bases allows the lamps to be correctly positioned as a light source and also to be easily inserted into sockets or to be detached therefrom. Accordingly, the step of securing the base to the lead wires is very important in a process of manufacturing a lamp, so that the process is relatively time consuming. Especially, in a lamp for use with the motion-picture projector wherein a correct position of a light source is required, a base is secured to lead wires and a metal flange is provided on the outer surface of the base to be thereafter welded thereto, for instance, by soldering after the adjustment of a distance is made between a light source thereof and the metal strip.

Accordingly, it is an object of the present invention to provide an incandescent lamp in which no base is required so that the step of securing a base becomes unnecessary, thereby saving the time wasted in the prior art as mentioned above.

It is another object of the present invention to provide an incandescent lamp in which the position of the light source is easily and correctly determined or maintained as compared to conventional lamps.

SUMMARY OF THE INVENTION

According to one aspect of the present invention, there is provided an incandescent lamp comprising a bulb, a stem, a metal ring body, lead wires penetrating the stem and a filament welded to the lead wires at the upper end thereof, wherein the metal ring body is airtightly welded to both the stem with the use of an oxidation film on the inner surface thereof and the bulb with use of another oxidation film on the outer surface thereof.

In the construction of a conventional lamp, a glass bulb is hermetically sealed to a glass stem and a base is also hermetically sealed to the stem at the outside thereof. According to the present invention, however, a metal ring body with oxidation films on both surfaces thereof is positioned between a stem and a glass bulb and welded thereto. This allows the metal ring body to function as a base and to secure a lamp in the correct position thereby achieving the above mentioned objects.

BRIEF DESCRIPTION OF THE DRAWINGS

The aforementioned and other objects and features of the present invention will become apparent from the following descriptions of preferred embodiments, when taken in conjunction with the appended drawings in which.

DETAILED DESCRIPTION OF THE PREFERRED EMBODIMENTS

Figure 1:
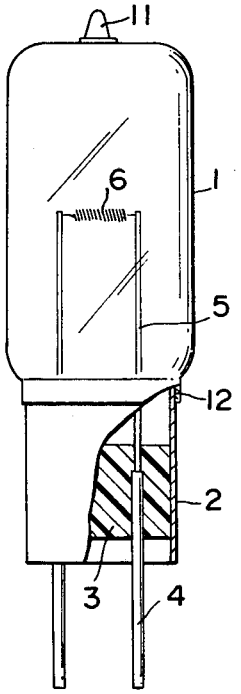
FIG. 1 is a perspective view partly in section illustrating an embodiment according to the present invention.

Referring now to FIG. 1, there is shown an incandescent lamp which comprises a bulb 1, a metal ring body 2, a stem 3 made of glass, pins 4, lead wires 5 and a filament 6. The bulb 1 is provided with an exhaust tube 11 on the top thereof to exhaust air therefrom. The lead wires 5 are respectively connected with the pins 4 in an appropriate manner and provided with the filament welded thereto. Alternatively, the lead wires 5 may be formed integral with the pins 4.

Figure 2:
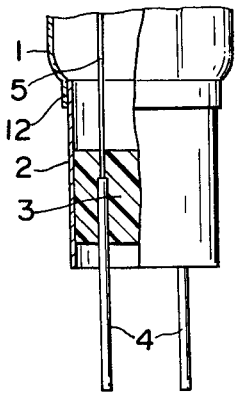
FIG. 2 is a partially enlarged sectional view illustrating a main portion of a lamp according to the present invention, FIGS. 3 A, B and C are explanatory views illustrating each step of a method of manufacturing a lamp according to the present invention, FIGS. 4A and B are respectively elevation and plan views of a further embodiment of the invention, and FIGS. 5A and B are respectively elevation and plan views of a modification of the embodiment of FIGS. 4A and B.

Referring next to FIG. 2, there is shown a main portion of a lamp according to the present invention. A metal ring body 2 is treated to have oxidation layers on the inner and outer surfaces thereof. A stem 3 is hermetically sealed to the metal ring body 2, midway between the ends thereof, by the use of the oxidation layer on the inner surface thereof. A plurality of penetrating members consisting of pins 4 and lead wires 5 welded to each other at respective joint portions pass through the stem 3 in an air-tight manner. A bulb 1 is sealed to the upper outside portion of the metal ring body 2 by the use of the oxidation layer on the outer surface of thereof.

In use of such an incandescent lamp, the lamp is inserted into a socket not shown in such a manner that the lower portion of metal ring body 2 is in contact with the mating portion of the socket so that lead wires 4 are electrically connected with corresponding terminals of the socket. The position of the light source (a light-center-distance) is determined by the distance between the filament 6 and the lower portion of the metal ring body 2.

Figure 3A:
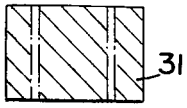
Figure 3B:
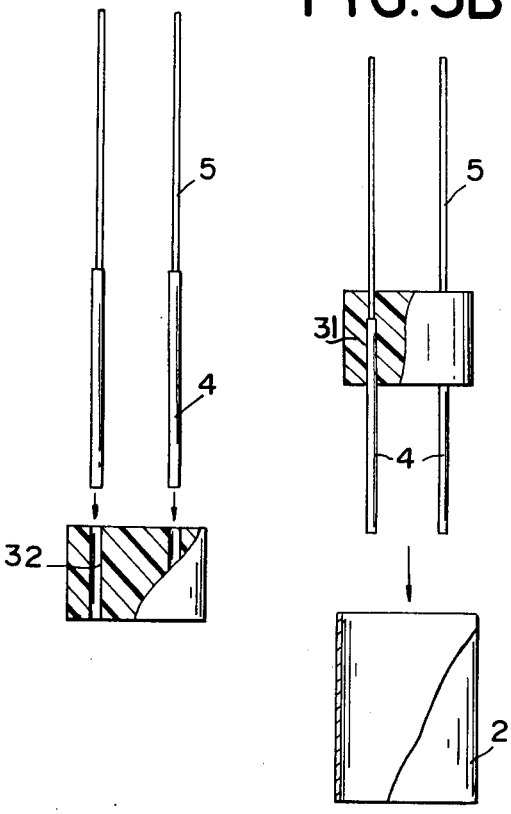
Figure 3C:
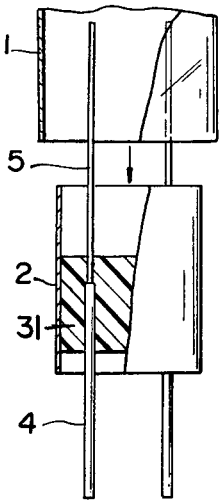

Referring to FIGS. 3 A, B and C, there are shown the steps of manufacturing a lamp according to the present invention. Glass powders are, in a known manner to form a cylindrical stem member 31 having apertures 32 corresponding in number to the pins of the incandescent lamp. The stem 31 with pins 4 and lead wires 5 inserted into the apertures 32 thereof is forced to a position inside a metal ring body 2 having oxidation layers previously formed on the inner and outer surfaces thereof in a well known manner (see FIG. 3 A). The stem 31 is securely welded to the metal ring body 2 with the use of the oxidation layer thereof in a welding furnace (see FIG. 3 B). Next, a filament 6 is welded to lead wires 5 at a predetermined point determined by measuring the distance from the lower portion of the metal ring body 2 to a filament welding portion in accordance with a desired light-center-distance. Further, a bulb 1 is sealingly overlapped with the upper outside portion of the metal ring body 2 with the use of the oxidation layer on the outer surface thereof (see FIG. 3 C). Finally, air is exhausted from the bulb through an exhaust tube.

In the present invention, air-tight welded portions (i.e. hermetical seals) are obtained respectively between a stem 3 and metal ring body 2 and between the metal ring body 2 and a bulb 1 with the use of oxidation layers formed on the inner and outer surfaces of the metal ring body 2 in a well known manner. There can be available an alloy of nickel, copper and iron, an alloy of nickel and iron, an alloy of nickel, chromium and iron and an alloy of chromium and iron as metals for use in such a welding or sealing operation. In addition, copper or aluminum is also useful for the same purpose. On the other hand, borosilic glass, alkali lead glass, soda lime glass etc. may be used to allow a complete sealing with the metal ring body 2. However, material of glass is required to conform in coefficient of thermal expansion to the material of the metal of body 2 to maintain the seals and to avoid voids or cracks. Therefore, an appropriate selection of materials may be made in accordance with the use of the lamp.

Although a formation of an oxidation layer on a metal surface is well known as a treatment for protecting metals, oxidation layers in the present invention not only provide hermetic seals but also function as protective layers which avoid an oxidation of the metal ring body except at the seal portions.

The following effects are expected due to the construction of a lamp according to the present invention.

(1) Labour and time are greatly saved because the step of securing a base becomes unnecessary as a result of the elimination of the base.

(2) The position of the light source is easily fixed. That is, a filament may be welded to the lead wires at a predetermined point, the position of which is determined by the measurement of a distance from the lower portion of a metal ring body thereto so that the position of the light source may be fixed with a higher accuracy can in an easily achieved manner.

(3) The production of a stem is easily made because the stem is formed inside a metal ring body. In this case, various metal ring bodies of other shapes may be used, for instance, of ellipse, square, rectangle etc., other than the circular shape illustrated in the aforementioned embodiment.

Figure 4A:
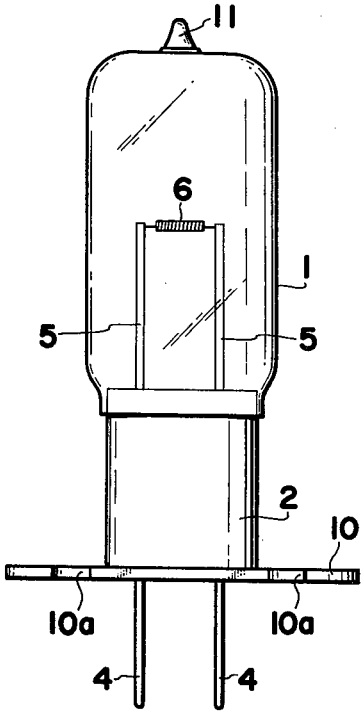
Figure 5A:
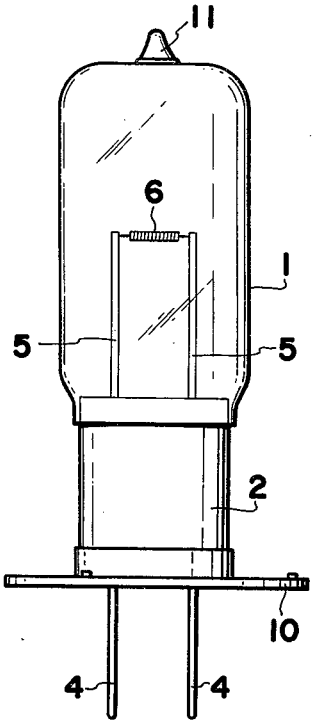
Figure 4B:
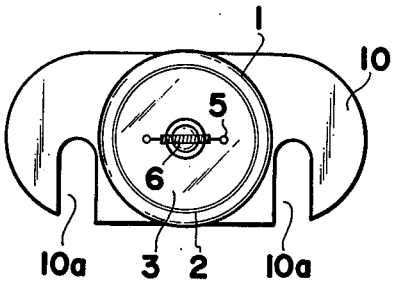
Figure 5B:
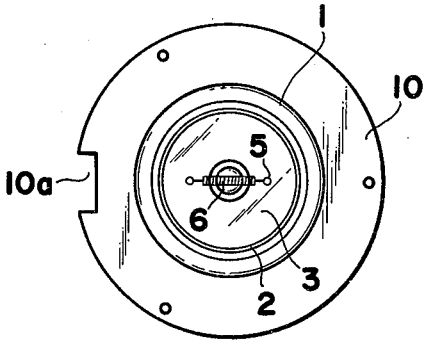

(4) A metal ring body is used as explained above so that an alteration of the lower portion thereof can be easily made in construction. For instance, a pair of legs may be provided at the lower end of the metal ring body by bending the end. Also, the lower end of metal ring 2 may have attached thereto a metal flange having therein one (FIGS. 5A and B) or plural (FIGS. 4A and B) recesses 10*a* for positioning and mounting of the lamp.

Although the present invention has been described with reference to the preferred embodiments thereof, many modifications and alterations may be made thereto within the scope of the present invention as defined by the claims. For instance, the pins may be altered with regard to the number and construction thereof, and the socket may be also changed in accordance with the alteration of the pins. Further, the filament may be altered with regard to the shape thereof and the lead wires may be also altered with regard to the construction and number thereof. Still further, a fuse may be provided in the bulb, and an exhaust tube may be provided at the stem instead of the bulb, and the stem may be provided with a guide.

What I claim is:

1. An incandescent lamp comprising:

a metal ring body having a circular cross-section, first and second ends, smooth inner and outer surfaces, and first and second oxidation layers on said inner and outer surfaces, respectively;

a light transparent bulb having an exhaust pipe therein and an open end, the inner surface of said open end of said bulb being welded to said outer surface of said metal ring body, at said first end thereof only, by means of said second oxidation layer, to thereby form a hermetic seal therebetween;

a cylindrical stem having an outer diameter equal to the inner diameter of said metal ring body, the entire outer circumference of said stem being welded to said inner surface of said metal ring body, at a position between said first and second ends thereof, by means of said first oxidation layer, to thereby form a hermetic seal therebetween, said second end of said metal ring body extending beyond said stem;

a light emitting filament positioned within said bulb; and lead wires extending through said stem into said bulb and supporting said filament for applying voltage thereto.

2. A lamp as claimed in claim 1, further comprising a flange attached to said second end of said metal ring body and extending outwardly therefrom.

* * * * *